US005512531A

United States Patent [19]

Miura et al.

[11] Patent Number: 5,512,531

[45] Date of Patent: Apr. 30, 1996

[54] THERMAL TRANSFER RECORDING MATERIAL AND IMAGE FORMING METHOD

[75] Inventors: Norio Miura; Tawara Komamura, both of Hino, Japan

[73] Assignee: Konica Corporation, Tokyo, Japan

[21] Appl. No.: 113,430

[22] Filed: Aug. 27, 1993

[51] Int. Cl.[6] ..... B41M 5/035; B41M 5/38

[52] U.S. Cl. ..... 503/227; 428/195; 428/341; 428/913; 428/914

[58] Field of Search ..... 8/471; 428/195, 428/913, 914, 340, 341; 503/227

[56] References Cited

FOREIGN PATENT DOCUMENTS 0535608 4/1993 European Pat. Off. ..... 503/227

*Primary Examiner*—B. Hamilton Hess

*Attorney, Agent, or Firm*—Frishauf, Holtz, Goodman, Langer & Chick

[57] ABSTRACT

Disclosed is an image forming method which has the steps of:

(a) superposing a thermal recording material and an image-receiving material, (b) heating the thermal transfer recording material to the extent according to image information; and (c) forming an image on the image-receiving material with a chelate dye formed upon reaction of a metal source being present in the image-receiving material or in a heat-fusible layer of the thermal transfer recording material and a yellow dye represented by Formula 1:

Formula 1 wherein $R_1$ and $R_2$ independently represent a hydrogen atom or a substituent; $R_3$ represents an alkyl group or aryl group which may have a substituent; Z represents a group of atoms necessary to form a 5- or 6-membered aromatic ring with two carbon atoms.

15 Claims, 1 Drawing Sheet

THERMAL TRANSFER RECORDING MATERIAL AND IMAGE FORMING METHOD

FIELD OF THE INVENTION

The present invention relates to a thermal transfer recording material and an image forming method, more specifically a thermal transfer recording material for obtaining a high-density yellow image with good image stability and an image forming method making possible efficient yellow image recording therewith.

BACKGROUND OF THE INVENTION

Traditionally, there have been investigated color image recording techniques for obtaining color hard copies by means of ink jets, electrophotography, thermal transfer, silver halide light-sensitive materials, etc. Of these means, thermal transfer recording materials in particular are advantageous that they permit easy operation and maintenance and system size reduction and cost reduction and that running cost is low.

Meantime, dyes used in the thermal transfer recording material are important in thermal transfer recording; conventional dyes used for this purpose are faulty that the obtained image is poor in stability, particularly fixability and light fastness.

In an attempt to solve this problem, Japanese Patent Publication Open to Public Inspection (hereinafter referred to as Japanese Patent O.P.I. Publication) Nos. 78893/1984, 109349/1984 and 2398/1985 disclose image forming methods wherein an image is formed with a chelatable thermally diffusible dye chelated on an image-receiving material.

However, although these image forming methods are excellent as to improvement of fixability and light fastness, the dyes disclosed in these patent publications do not always meet the following performance requirements for chelatable dyes used in the thermal transfer recording material (hereinafter referred to as post-chelating dyes).

1) Chelating offers a chelate dye image with good tone. 2) The post-chelating dye has good thermal diffusibility. 3) The post-chelating dye does not migrate to the ink sheet's back face etc. during ink sheet storage. 4) The post-chelating dye has good solvent solubility (ink formability). 5) The post-chelating dye has good reactivity with metal ion donor compounds. 6) The chelate dye image has excellent stability (fixability, light fastness).

There is therefore a need for further improvement in the above performance of post-chelating dyes.

SUMMARY OF THE INVENTION

With this situation in mind, the present invention has been developed. Accordingly, it is an object of the present invention to provide a thermal transfer recording material incorporating a post-chelating dye capable of offering a good yellow color tone upon chelating, and an image forming method using the thermal transfer recording material.

It is another object of the present invention to provide a thermal transfer recording material incorporating a post-chelating dye which is good in ink formability, thermal diffusibility and chelate reactivity, which is capable of offering a high-density image with good storage stability and which is excellent in ink sheet storage stability, and an image forming method using the thermal transfer recording material.

Figure 1:
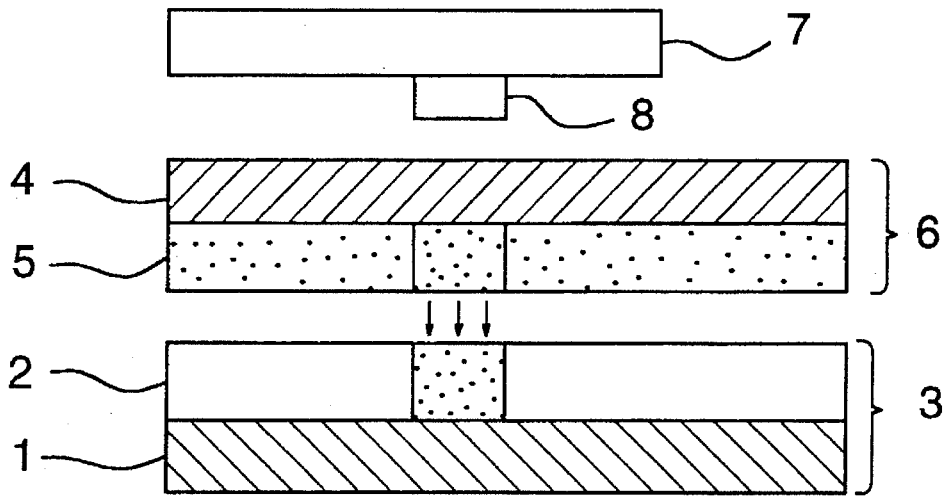
FIG. 1 illustrates an example of the image forming method using the thermal transfer recording material of the present invention.

In these figures, the numerical symbols have the following definitions:

1: Support
2: Image-receiving layer
3: Image-receiving material
4: Support
5: Thermal transfer layer
6: Thermal transfer recording material
7: Thermal head
8: Heating resistor
9: Heat-fusible layer
**9*a***: Heat-fusible layer after cohesive failure or interfacial peeling
10: Thermal transfer recording material
11: Ordinary paper image-receiving material

DETAILED DESCRIPTION OF THE PREFERRED EMBODIMENT

The above objects of the present invention can be accomplished by the following constituent.

A thermal transfer recording material having on the support a thermal transfer layer containing at least a dye represented by the following formula 1:

Formula 1

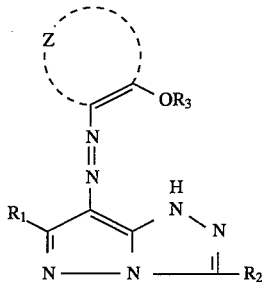

wherein $R_1$ and $R_2$ independently represent a hydrogen atom or a substituent; $R_3$ represents an alkyl group or aryl group which may have a substituent; Z represents a group of atoms necessary to form a 5- or 6-membered aromatic ring in cooperation with two carbon atoms.

An image forming method wherein while keeping an image-receiving material superposed on a thermal transfer recording material having on the support a thermal transfer layer containing the above-mentioned dye of formula 1, an image is formed on the image-receiving material with a chelate dye formed upon reaction of the dye with a compound containing a metal ion (hereinafter referred to as metal source).

The dye represented by formula 1 is hereinafter described in detail.

Examples of the substituents represented by $R_1$ and $R_2$ include halogen atoms, alkyl groups having 1 to 12 carbon atoms which may be substituted by a substituent bound via an oxygen atom, a nitrogen atom, a sulfur atom or a carbonyl group, or by an aryl group, an alkenyl group, an alkinyl group, a hydroxyl group, an amino group, a nitro group, a carboxyl group, a cyano group or a halogen atom, such as methyl, isopropyl, t-butyl, trifluoromethyl, methoxymethyl, 2-methanesulfonylethyl, 2-methanesulfonamidoethyl and cyclohexyl, aryl groups such as phenyl, 4-t-butylphenyl, 3-nitrophenyl, 3-acylaminophenyl and 2-methoxyphenyl, cyano groups, alkoxyl groups, aryloxy groups, acylamino groups, anilino groups, ureide groups, sulfamoylamino groups, alkylthio groups, arylthio groups, alkoxycarbonylamino groups, sulfonamide groups, carbamoyl groups, sulfamoyl groups, sulfonyl groups, alkoxycarbonyl groups, heterocyclic oxy groups, acyloxy groups, carbamoyloxy groups, silyloxy groups, aryloxycarbonylamino groups, imide groups, heterocyclic thio groups, phosphonyl groups and acyl groups.

The alkyl group and aryl group represented by $R_3$ is exemplified by the same alkyl groups and aryl groups represented by $R_1$ and $R_2$.

The 5- or 6-membered aromatic ring represented by Z, formed along with two carbon atoms, is exemplified by rings of benzene, pyridine, pyrimidine, triazine, pyrazine, pyridazine, pyrrole, furan, thiophene, pyrazole, imidazole, triazole, oxazole and thiazole. These rings may further form a condensed ring with another aromatic ring. These rings may have a substituent thereon, which substituent is exemplified by the same substituents as those represented by $R_1$ and $R_2$.

The dye for the present invention, represented by formula 1, can be produced by, for example, diazotizing a compound represented by the following Formula 4 in accordance with the method described in Chemical Reviews, Vol.175,241 (1975), and then subjecting it to a known coupling reaction with a compound represented by the following formula 3.

Formula 2

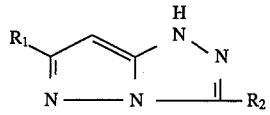

Formula 3

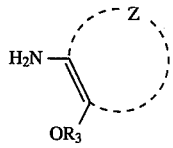

wherein $R_1$, $R_2$, $R_3$ and Z have the same definitions as $R_1$, $R_2$, $R_3$ and Z in the above formula 1, respectively.

Typical examples of the dye for the present invention, represented by formula 1, (hereinafter referred to as the dye of the present invention), are given below, but the scope of the invention is not limited to these examples.

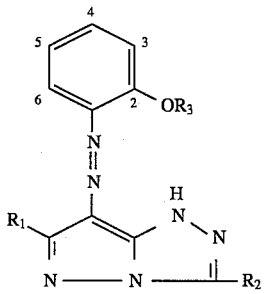

| Compound No. | $R^1$ | $R^2$ | $R^3$ | $R^4$ |
|---|---|---|---|---|
| Y-1 | $-CH_3$ | $-C_4H_9$ | $-CH_3$ | — |
| Y-2 | $-C_3H_7$ (i) | 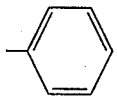 | $-CH_3$ | — |
| Y-3 | $-C_3H_7$ (i) | $-C_2H_5$ | $-CH_3$ | — |
| Y-4 | $-CH_3$ | $-C_2H_5$ | $-CH_3$ | — |
| Y-5 | $-C_3H_7$ (i) | 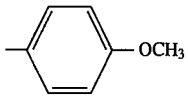 | $-CH_3$ | 4-Cl |
| Y-6 | $-C_3H_7$ (i) | $-C_2H_5$ | $-CH_3$ | 4-$CO_2CH_3$ |
| Y-7 | $-C_3H_7$ (i) | $-C_4H_9$ | $-CH_3$ | 5-$CO_2CH_3$ |
| Y-8 | $-C_4H_9$ (t) | $-C_4H_9$ | $-CH_3$ | — |
| Y-9 | $-C_3H_7$ (i) | 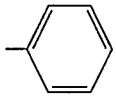 | $-C_3H_7$ (i) | — |
| Y-10 | $-C_3H_7$ (i) | 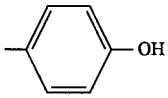 | $-CH_3$ | — |
| Y-11 | $-C_3H_7$ (i) | $-C_3H_7$ | $-CH_3$ | 5-Cl |

-continued
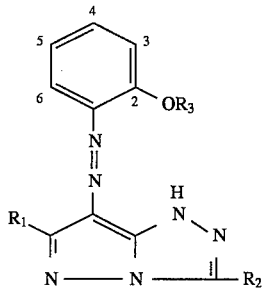
| Compound No. | $R^1$ | $R^2$ | $R^3$ | $R^4$ |
|---|---|---|---|---|
| Y-12 | $-C_3H_7$ (i) | 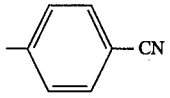 | $-CH_3$ | — |
| Y-13 | $-C_4H_9$ (t) | 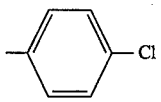 | $-CH_3$ | — |
| Y-14 | $-SCH_3$ | 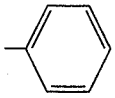 | $-CH_3$ | — |
| Y-15 | 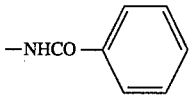 | $-C_2H_5$ | $-CH_3$ | — |
| Y-16 | 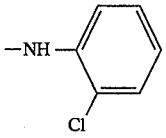 | $-C_2H_5$ | $-CH_3$ | — |
| Y-17 | $-OCH_3$ | $-C_4H_9$ | $-CH_3$ | — |
| Y-18 | $-C_4H_9$ (t) | $-C_4H_9$ | $-CH_3$ | 4-$CO_2H$ |
| Y-19 | $-C_3H_7$ (i) | 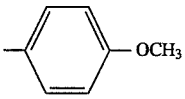 | $-CH_3$ | — |
| Y-20 | $-C_3H_7$ (i) | 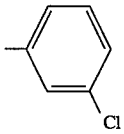 | $-CH_3$ | — |
| Y-24 | $-C_3H_7$ (i) | $-C_2H_5$ | $-CH_3$ | 5-Cl |
| Y-25 | $-C_4H_9$ (t) | $-C_4H_9$ | $-CH_3$ | 5-Cl |
| Y-26 | $-C_4H_9$ (t) | $-C_2H_5$ | $-CH_3$ | 5-Cl |
| Y-27 | $-C_4H_9$ (t) | 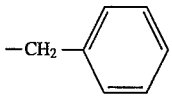 | $-CH_3$ | 5-Cl |
| Y-28 | $-C_4H_9$ (t) | 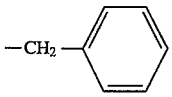 | $-CH_3$ | — |
| Y-29 | $-C_4H_9$ (t) | $-CH(C_2H_5)C_4H_9$ | $-CH_3$ | 5-Cl |
| Y-30 | $-C_4H_9$ (t) | $-C_6H_{13}$ | $-CH_3$ | 5-Cl |
| Y-31 | $-C_4H_9$ (t) | $-CH_3$ | $-CH_3$ | 5-Cl |

-continued

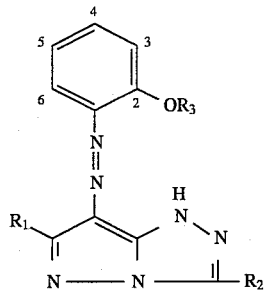

| Compound No. | $R^1$ | $R^2$ | $R^3$ | $R^4$ |
|---|---|---|---|---|
| Y-21 | | | | |
| Y-22 | | | | |
| Y-23 | | | | |

The thermal transfer recording material of the present invention comprises a support and a thermal transfer layer on a support containing the dye of the present invention formed thereon, the dye content in the thermal transfer layer being preferably 0.05 to 10 g per $m^2$ of the support.

A thermal transfer layer can be formed by dissolving or finely dispersing one or more kinds of the above dye, along with a binder, in a solvent to prepare an ink solution for forming a thermal transfer layer, and coating and appropriately drying the ink solution on the support. The thickness of the thermal transfer layer is preferably 0.1 to 10 μm, as of dry film thickness.

The above-described binder is preferably a solvent-soluble polymer such as acrylic resin, methacrylic resin, polystyrene, polycarbonate, polysulfone, polyethersulfone, polyvinylbutyral, polyvinyl acetal, nitrocellulose or ethyl cellulose. One or more kinds of these binders may be used in the form of latex dispersion, as well as in solution in organic solvents. The amount of binder used is preferably 0.1 to 20 g per $m^2$ of support. Examples of the above-described organic solvent include alcohols such as ethanol and propanol, cellosolves such as methyl cellosolve, aromatics such as toluene and xylene, esters such as ethyl acetate and butyl acetate, ketones such as acetone and methyl ethyl ketone and ethers such as tetrahydrofuran and dioxane.

Any material can be used as the above-described support, as long as it has good dimensional stability and endures heating by a thermal head etc. during recording. It is preferable to use a thin paper such as condenser paper or glassine paper, or a heat-resistant plastic film such as of polyethylene terephthalate, polyamide or polycarbonate. The thickness of the support is preferably 2 to 30 μm. Also, the support preferably has a subbing layer comprising a polymer selected to improve adhesion with the binder and to prevent dye transfer and staining to the support. The back face (the side opposite to the thermal transfer layer) of the support may have a slipping layer for preventing thermal head cohesion to the support.

The thermal transfer recording material of the present invention may have a heat-fusible layer containing a heat-fusible compound as described in Japanese Patent O.P.I. Publication No. 106997/1984, on the thermal transfer layer, to use an image-receiving material having no particular image-receiving layer as ordinary paper, as described later. This heat-fusible compound is preferably a colorless or white compound which fuses at a temperature of 65° to 150° C., exemplified by waxes such as carnauba wax, beeswax and candelilla wax. These heat-fusible layers may contain polymers such as polyvinyl pyrrolidone, polyvinyl butyral, polyester and vinyl acetate.

When applying the thermal transfer recording material of the present invention to full-color image recording, it is preferable to sequentially and repeatedly coat on the same surface of the support a total of three layers, namely a yellow thermal transfer layer containing the dye relating to the invention, a magenta thermal transfer layer containing a thermally diffusible dye capable of forming magenta images and a cyan thermal transfer layer containing a thermally diffusible dye capable of forming cyan images. Also, a total of four layers, additionally comprising another thermal transfer layer containing a black-image-forming substance, may be coated on the same surface sequentially and repeatedly as necessary.

In the image forming method of the present invention, a thermal transfer layer of the above-described thermal transfer recording material and an image-receiving material are superposed, after which the thermal transfer recording material is heated to the extent according to image information, to form an image on the image-receiving material with a chelate dye formed upon reaction of a metal source and the dye of the present invention. In this case, because a dye represented by the above formula 1 is used in the invention, a high-density yellow image with high image stability and good color reproducibility can be obtained efficiently. The metal source may be present in the image-receiving material or in the heat-fusible layer on the thermal transfer layer.

The image forming method of the present invention is hereinafter described with reference to the drawings. In FIG. 1, when a metal source is present in the image-receiving layer of an image-receiving material 3 comprising a support 1 and an image-receiving layer 2, the above dye in the thermal transfer layer of a thermal transfer recording material 6 comprising a support 4 and a thermal transfer layer 5 is diffusely migrated to the image-receiving material 3 upon exposure to heat from, for example, the heating resistor 8 of a thermal head 7, and reacts with the metal source in an image-receiving layer 2 to form a chelate dye image.

Figure 2:
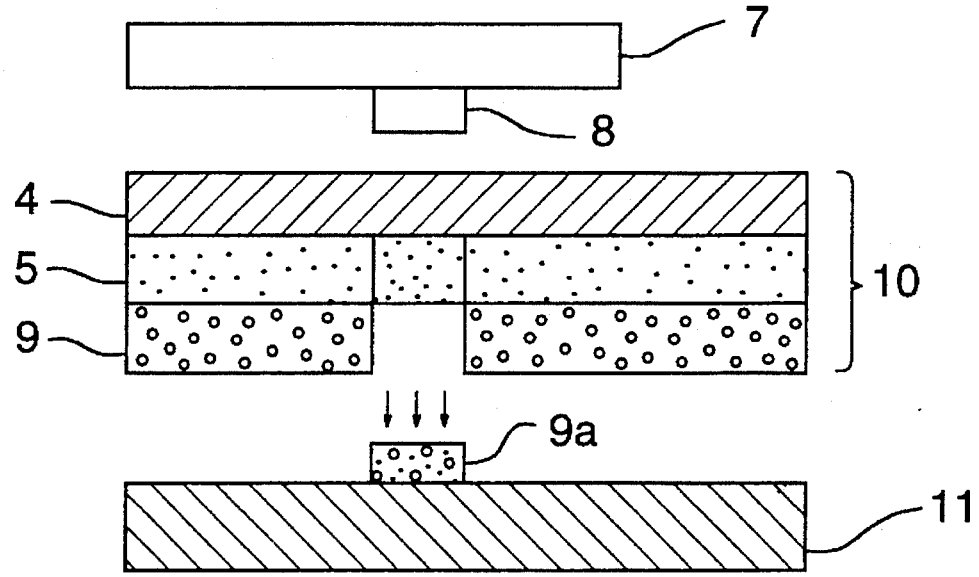
FIG. 2 illustrates another example of the image forming method using the thermal transfer recording material of the present invention.

In FIG. 2, when a metal source is present in the heat-fusible layer 9 on a thermal transfer layer 5, the dye in the thermal transfer layer 5 of a thermal transfer recording material 10 comprising a support 4, a thermal transfer layer 5 and a heat-fusible layer 9 is diffusible migrated to the heat-fusible layer 9 upon exposure to heat from, for example, the heating resistor 8 of a thermal head 7, and reacts with the metal source therein to form a chelate dye, and the heat-fusible layer containing this chelate dye becomes **9*a* upon cohesive failure or interfacial peeling and then migrates to image-receiving material 11**, where an image is formed.

Examples of the above-described metal source include inorganic or organic salts of metal ions and metal complexes, with preference given to organic acid salts and complexes. Metals for this purpose include monovalent and polyvalent metals belonging to groups I through VIII in the periodic table of elements, with preference given to Al, Co, Cr, Cu, Fe, Mg, Mn, Mo, Ni, Sn Ti and Zn, with greater preference given to Ni, Cu, Cr, Co and Zn. Metal sources are exemplified by salts of $Ni^{2+}$, $Cu^{2+}$, $Cr^{2+}$, $Co^{2+}$ and $Zn^{2+}$ with aliphatic acids such as acetic acid and stearic acid, and with aromatic carboxylic acids such as benzoic acid and salicylic acid. Also, complexes represented by the following formula 4 are particularly preferably used.

$$[M(Q_1)_q(Q_2)_r(Q_3)_s]^{P+}P(L^-) \qquad \text{Formula 4}$$

wherein M represents a metal ion, preferably $Ni^{2+}$, $Cu^{2+}$, $Cr^{2+}$, $Co^{2+}$ or $Zn^{2+}$.

$Q_1$, $Q_2$ and $Q_3$, whether identical or not, independently represent a coordinate compound capable of coordinately binding to a metal ion represented by M. These coordinate compounds can be selected from, for example, the coordinate compounds described in Chelate Chemistry (5), Nankodo. $L^-$ represents an organic anion group, exemplified by a tetraphenyl borate anion and an alkylbenzenesulfonate anion. q represents an integer of 1, 2 or 3, r being 1, 2 or 0, and s being 1 or 0, depending on the coordinate position, 4 or 6, of the complex represented by the above formula, or depending on the coordinate numbers of $Q_1$, $Q_2$ and $Q_3$. p represents 1 or 2.

The amount of metal source added is preferably 0.5 to 20 g, more preferably 1 to 15 g per $m^2$ of image-receiving material or heat-fusible layer.

The above-described image-receiving material used in the present invention generally comprises a support of paper, plastic film or paper-plastic film composite, and an image-receiving layer formed thereon, which image-receiving layer comprises one or more kinds of polymer layers of polyester resin, polyvinyl chloride resin, vinyl chloride copolymer resin with another monomer such as vinyl acetate, polyvinyl butyral, polyvinyl pyrrolidone and polycarbonate. The support itself may be used as the image-receiving material.

EXAMPLES

The present invention is hereinafter described in more detail by means of the following examples, but the scope of the invention is not limited to these examples.

Example 1

Preparation of Ink

The following starting materials were mixed to yield a uniform ink solution containing the thermally diffusible dye relating to the present invention.

| | |
|---|---|
| Thermally diffusible dye Y-1 | 5 g |
| Polyvinyl butyral resin BL-1 (produced by Sekisui Chemical Co., Ltd.) | 5 g |
| Methyl ethyl ketone | 200 ml |

Preparation of Thermal Transfer Recording Material

The above ink was coated and dried on a polyethylene terephthalate base of 4.5 μm thickness, using a wire bar coater, to a final coating amount of 0.8 g/$m^2$, to prepare thermal transfer recording material No. 1 comprising the polyethylene terephthalate film and a thermal transfer layer formed thereon. The back face of the polyethylene terephthalate base had a nitrocellulose layer containing a silicon-modified urethane resin SP-2105 (produced by Dainichiseika Color & Chemicals Manufacturing Co., Ltd.) as an antisticking layer.

Preparation of Image-Receiving Material

On a paper support, laminated with polyethylene on both faces (containing a white pigment $TiO_2$ and a bluing agent on one polyethylene layer), an ester-modified silicon (coating amount 0.15 g/$m^2$) and a polyvinyl chloride resin containing the following metal source (coating amount 3.5 g/$m^2$) were coated as a image-receiving layer to an overall coating amount of 5 g/$m^2$ to yield an image-receiving material.

Metal source:

$$[Ni(NH_2CH_2CONH_2)_3]^{2+}2[C_6H_5)_4B]^-$$

Thermal Transfer Recording Method

While keeping superposed the thermal transfer recording material and image-receiving material described above and applying a thermal head to the back face of the thermal transfer recording material, image recording was conducted under the following conditions to yield a yellow image with excellent gradation.

Recording Conditions

Main scan/subscan recording density: 8 dots/mm

Recording power consumption: 0.6 W/dot

Heating time: Stepwise adjusted between 20 msec and 0.2 msec.

The thus-obtained yellow image, for maximum density, chelating reactivity, fixability and light fastness, and the thermal transfer recording material (also referred to as ink sheet), for storage stability, were evaluated as follows. The results are given in Table 1.

Maximum Density

Using the X-rite 310TR, the maximum reflective density of the image (usually located in the portion of maximum applying time) was determined.

Chelating Reactivity o: Almost satisfactory chelate dye image formed.

Δ: Chelate dye formation poor.

x: Chelate dye formed only partially.

Fixability

While keeping superposed the image-receiving layer face of the image and the coating face of a sheet comprising a polyethylene terephthalate film of 180 μm thickness and a nitrocellulose layer of 5 μm thickness formed thereon, heating was conducted at 140° C. for 2 minutes, and the degree of dye transfer from the image-receiving layer to the nitrocellulose layer was macroscopically evaluated. Fixability increases as dye transfer decreases.

o: No transfer noted.

Δ: Slight transfer noted.

x: Marked transfer noted.

Light Fastness

The image was subjected to exposure with a xenon fade-O-meter for 72 hours, and light fastness was evaluated on the basis of the dye residual rate $(D/D_0)\times 100\%$ in which $D_0$ is pre-irradiation density and D is post-irradiation density.

Storage stability of Ink Sheet

While being kept superposed, the ink face and back face (antisticking layer face) of the ink sheet were left at 55° C. for 3 days, and dye migration to the antisticking layer surface was macroscopically observed to evaluate the storage stability of the ink sheet.

o: Almost no back transfer noted.

Δ: Back transfer noted.

x: Marked back transfer noted.

Examples 2 through 20

Nine kinds of thermal transfer recording material Nos. 2 through 10 were prepared in the same manner as in Example 1 except that the dye Y-1 in Example 1 was replaced with Y-2, Y- 4, Y-8, Y-11, Y-13, Y-15, Y-20, Y-24 and Y-26, respectively. Using these thermal transfer recording materials, image recording was conducted under the same conditions; a yellow image with good gradation was obtained in any case.

These images and ink sheets were evaluated in the same manner as in Example 1. The results are given in Table 1.

Comparative Examples 1 and 2

Two kinds of comparative thermal transfer recording materials (Comparative Examples 1 and 2) were prepared in almost the same manner as in Example 1 except that the dye used in Example 1 was replaced with the following comparative dyes A and B, respectively. Using these comparative thermal transfer recording materials, image recording was conducted under the same conditions. These images and ink sheets were evaluated in the same manner as in Example 1. The results are given in Table 1.

Comparative dye A

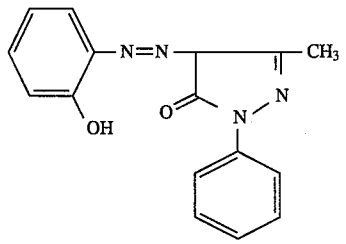

Comparative dye B

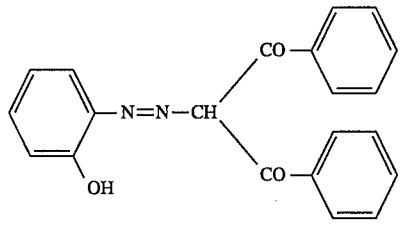

TABLE 1

| Thermal transfer recording material | Dye | Maximum density | Chelating reactivity | Fixability | Light fastness | Storage stability (%) |
|---|---|---|---|---|---|---|
| Example 1 | Y-1 | 1.78 | O | O | 85 | O |
| Example 2 | Y-2 | 1.88 | O | O | 90 | O |
| Example 3 | Y-4 | 1.87 | O | O | 87 | O |
| Example 4 | Y-8 | 1.97 | O | O | 86 | O |
| Example 5 | Y-11 | 1.77 | O | O | 84 | O |
| Example 6 | Y-13 | 1.88 | O | O | 87 | O |
| Example 7 | Y-15 | 1.82 | O | O | 84 | O |
| Example 8 | Y-20 | 1.79 | O | O | 83 | O |
| Example 9 | Y-24 | 1.82 | O | O | 86 | O |
| Example 10 | Y-26 | 1.83 | O | O | 87 | O |
| Example 11 | Y-31 | 1.88 | O | O | 91 | O |
| Comparative Example 1 | Comparative dye A | 1.43 | Δ | X | 74 | X |
| Comparative | Comparative | 1.41 | Δ | Δ | 75 | Δ |

TABLE 1-continued

| Thermal transfer recording material | Dye | Maximum density | Chelating reactivity | Fixability | Light fastness | Storage stability (%) |
|---|---|---|---|---|---|---|
| Example 2 | dye B | | | | | |

As seen in Table 1, the thermal transfer recording material according to the present invention offered a high-density yellow image excellent in chelating reactivity, image fixability and light fastness and good ink sheet storage stability.

Example 12

On the same polyethylene terephthalate film as used as a support in Example 1, a cyan thermal transfer layer containing the following cyan image forming dye C-1 (coating amount 0.4 g/m$^2$), a magenta thermal transfer layer containing the following magenta image forming dye M-1 (coating amount 0.5 g/m$^2$) and a yellow thermal transfer layer containing the yellow image forming dye Y-31 of the present invention (coating amount 0.5 g/m$^2$) were sequentially coated, to prepare thermal transfer recording material No. 11. The binders in the respective thermal transfer layers were the same as those used in Example 1 (coating amount 0.4 g/m$^2$ for each layer).

Next, using the above thermal transfer recording material No. 12 and the same image-receiving material as in Example 1, a full-color image was formed with a NIKON full-color printer CP3000D; a full-color image with good color reproducibility was obtained. This image was found to have good storage stability (fixability, light fastness).

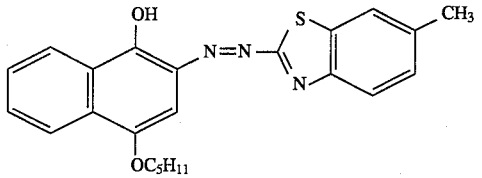

C-1

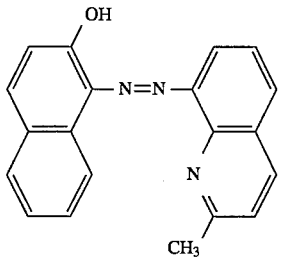

M-1

Example 13

On thermal transfer recording material No. 11 of Example 11 was coated as an interlayer 100 ml of an aqueous solution containing 5 g of a p-toluamide ball mill dispersion, 7 g of polyvinylpyrrolidone, 3 g of gelatin and 0.3 g of the following hardener H-1 to a p-toluamide coating amount of 0.5 g/m$^2$.

On this interlayer was coated by hot melt coating carnauba wax (coating amount 2.0 g/m$^2$) containing the metal source used in Example 1 (coating amount 1.0 g/m$^2$), the following UV absorbent UV-1 (coating amount 0.1 g/m$^2$), an antioxidant AO-1 (coating amount 0.1 g/m$^2$) and an ethylene-vinyl acetate copolymer (vinyl acetate content 20%, coating amount 0.2 g/m$^2$), as a heat-fusible layer, to yield thermal transfer recording material No. 13.

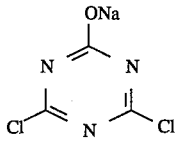

H-1

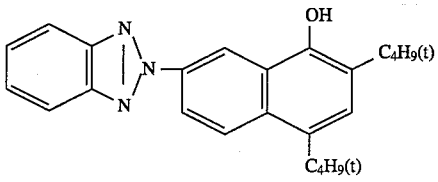

UV-1

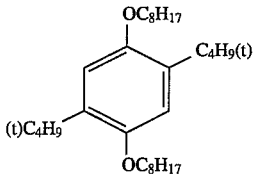

AO-1

Using this thermal transfer recording material No. 13 and an image-receiving material, full-color image recording was conducted in the same manner as in Example 12, using a full-color printer. The image-receiving material was ordinary white paper. The obtained full-color image was found to be good in color reproducibility, gradation and image storage stability. Ink sheet storage stability was also good.

What is claimed is:

1. An image forming method comprising the steps of:

(a) superposing a thermal transfer recording material and an image-receiving material, (b) heating the thermal transfer recording material to the extent according to image information; and (c) forming an image on the image-receiving material with a chelate dye formed upon reaction of a metal source being present in the image-receiving material or in a heat-fusible layer of the thermal transfer recording material and a yellow dye represented by Formula 1:

Formula 1

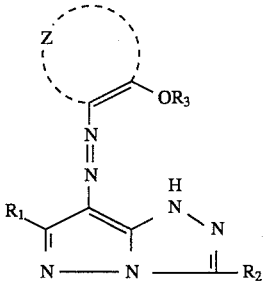

wherein $R_1$ and $R_2$ independently represent a hydrogen atom or a substituent; $R_3$ represents an alkyl group or aryl group which may have a substituent; Z represents a group of atoms necessary to form a 5- or 6-membered aromatic ring.

2. An image forming method of claim 1, wherein the thermal transfer recording material comprising a support having provided thereon the thermal transfer layer containing at least one yellow dye represented by said Formula 1.

3. An image forming method of claim 2, wherein the amount of said dye in said thermal transfer layer is within the range of from 0.05 to 10 g per $m^2$ of the support.

4. An image forming method of claim 1, wherein the metal source is selected from the group consisting of inorganic or organic salts of metal ions and metal complexes.

5. An image forming method of claim 4, wherein said metal source is selected from the salts of $Ni^{2+}$, $Cu^{2+}$, $Cr^{2+}$, $Co^{2+}$ and $Zn^{2+}$ with aliphatic acids or aromatic carboxylic acids.

6. An image forming method of claim 4, wherein said metal source is a metal complex represented by Formula 4:

$$[M(Q_1)_q(Q_2)_r)(Q_3)_s]^{P+}P(L^-) \qquad \text{Formula 4}$$

wherein M represents $Ni^{2+}$, $Cu^{2+}$, $Cr^{2+}$, $Co^{2+}$ or $Zn^{2+}$, $Q_1$, $Q_2$ and $Q_3$ independently represent a coordinate compound capable of coordinate bonding to said metal ion represented by M; $L^-$ represents an organic anion group; q represents an integer of 1, 2 or 3, r is 1, 2 or 0, and s is 1 or 0, p represents 1 or 2.

7. An image forming method of claim 4, wherein the amount of said metal source is 0.5 to 20 g per $m^2$ of the image-receiving material or the heat-fusible layer of the thermal transfer recording material.

8. An image forming method of claim 1, wherein the thermal recording material contains a binder selected from the solvent-soluble polymers consisting of acrylic resin, methacrylic resin, polystyrene, polycarbonate, polysulfone, polyethersulfone, polyvinylbutyral, polyvinyl acetal, nitrocellulose and ethyl cellulose; and the solvent is selected from alcohols, cellosolves, aromatic solvents, esters, ketones or ethers.

9. The image forming method of claim 8, wherein the amount of said binder is within the range of from 0.1 to 20 g per $m^2$ of the support.

10. An image forming method of claim 8, wherein one or more kinds of said solvent-soluble polymers are used in the form of a latex dispersion.

11. An image forming method of claim 1 wherein said 5- or 6-membered aromatic ring formed by Z is a benzene, pyridine, pyrimidine, triazine, pyrazine, pyridazine, pyrrole, furan, thiophene, pyrazole, imidazole, triazole, oxazole or thiazole ring.

12. An image forming method of claim 1 wherein the compound of formula 1 is one of compounds Y-1 through Y-23 defined below:

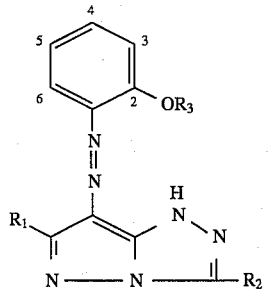

| Compound No. | $R^1$ | $R^2$ | $R^3$ | $R^4$ |
|---|---|---|---|---|
| Y-1 | $-CH_3$ | $-C_4H_9$ | $-CH_3$ | — |
| Y-2 | $-C_3H_7$ (i) | 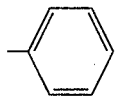 | $-CH_3$ | — |
| Y-3 | $-C_3H_7$ (i) | $-C_2H_5$ | $-CH_3$ | — |
| Y-4 | $-CH_3$ | $-C_2H_5$ | $-CH_3$ | — |
| Y-5 | $-C_3H_7$ (i) | 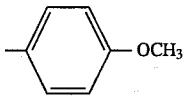 | $-CH_3$ | 4-Cl |
| Y-6 | $-C_3H_7$ (i) | $-C_2H_5$ | $-CH_3$ | 4-$CO_2CH_3$ |
| Y-7 | $-C_3H_7$ (i) | $-C_4H_9$ | $-CH_3$ | 5-$CO_2CH_3$ |
| Y-8 | $-C_4H_9$ (t) | $-C_4H_9$ | $-CH_3$ | — |
| Y-9 | $-C_3H_7$ (i) | 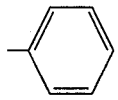 | $-C_3H_7$ (i) | — |

-continued
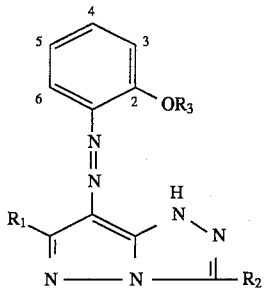
| Compound No. | $R^1$ | $R^2$ | $R^3$ | $R^4$ |
|---|---|---|---|---|
| Y-10 | $-C_3H_7$ (i) | 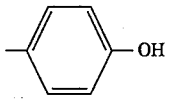 | $-CH_3$ | — |
| Y-11 | $-C_3H_7$ (i) | $-C_3H_7$ | $-CH_3$ | 5-Cl |
| Y-12 | $-C_3H_7$ (i) | 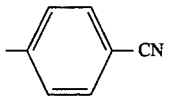 | $-CH_3$ | — |
| Y-13 | $-C_4H_9$ (t) | 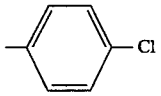 | $-CH_3$ | — |
| Y-14 | $-SCH_3$ | 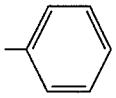 | $-CH_3$ | — |
| Y-15 | 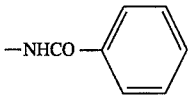 | $-C_2H_5$ | $-CH_3$ | — |
| Y-16 | 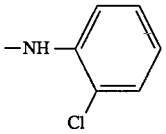 | $-C_2H_5$ | $-CH_3$ | — |
| Y-17 | $-OCH_3$ | $-C_4H_9$ | $-CH_3$ | — |
| Y-18 | $-C_4H_9$ (t) | $-C_4H_9$ | $-CH_3$ | 4-$CO_2H$ |
| Y-19 | $-C_3H_7$ (i) | 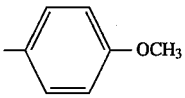 | $-CH_3$ | — |
| Y-20 | $-C_3H_7$ (i) | 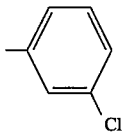 | $-CH_3$ | — |
| Y-24 | $-C_3H_7$ (i) | $-C_2H_5$ | $-CH_3$ | 5-Cl |
| Y-25 | $-C_4H_9$ (t) | $-C_4H_9$ | $-CH_3$ | 5-Cl |
| Y-26 | $-C_4H_9$ (t) | $-C_2H_5$ | $-CH_3$ | 5-Cl |
| Y-27 | $-C_4H_9$ (t) | 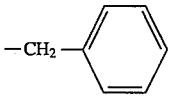 | $-CH_3$ | 5-Cl |

-continued

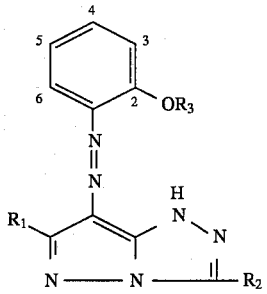

| Compound No. | $R^1$ | $R^2$ | $R^3$ | $R^4$ |
|---|---|---|---|---|
| Y-28 | $-C_4H_9$ (t) | 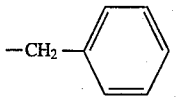 | $-CH_3$ | — |
| Y-29 | $-C_4H_9$ (t) | $-CH(C_2H_5)C_4H_9$ | $-CH_3$ | 5-Cl |
| Y-30 | $-C_4H_9$ (t) | $-C_6H_{13}$ | $-CH_3$ | 5-Cl |
| Y-31 | $-C_4H_9$ (t) | $-CH_3$ | $-CH_3$ | 5-Cl |
| Y-21 | | 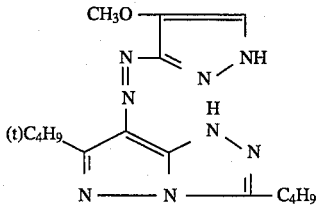 | | |
| Y-22 | | 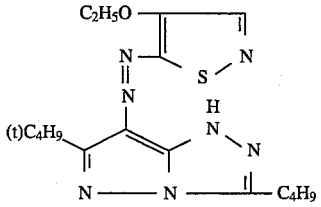 | | |
| Y-23 | | 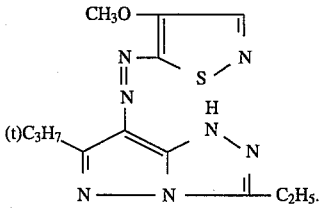 | | |

13. An image forming method comprising the steps of:

(a) superposing a thermal transfer recording material and an image-receiving material, (b) heating the thermal transfer recording material to the extent according to image information; and (c) forming an image on the image-receiving material with a chelate dye formed upon reaction of a metal source represented by Formula 4, being present in the image-receiving material or in a heat-fusible layer of the thermal transfer recording material and a yellow dye represented by Formula 1:

Formula 1

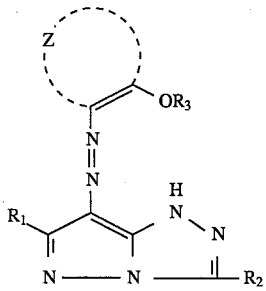

wherein $R_1$ and $R_2$ independently represent a hydrogen atom or a substituent; $R_3$ represents an alkyl group or aryl group which may have a substituent; Z represents a group of atoms necessary to form a 5- or 6-membered aromatic ring , $$[M(Q_1)_q(Q_2)_r(Q_3)_s]^{P+}P(L^-) \qquad \text{Formula 4}$$

wherein M represents $Ni^{2+}$, $Cu^{2+}$, $Cr^{2+}$, $Co^{2+}$ or $Zn^{2+}$, $Q_1$, $Q_2$ and $Q_3$ independently represent a coordinate compound capable of coordinate bond to said metal ion represented by M; $L^-$ represents an organic anion group; q represents an integer of 1, 2 or 3, r is 1, 2 or 0, and s is 1 or 0, p represents 1 or 2.

14. An image forming method of claim 13 wherein said 5- or 6-membered aromatic ring formed by Z is a benzene, pyridine, pyrimidine, triazine, pyrazine, pyridazine, pyrrole, furan, thiophene, pyrazole, imidazole, triazole, oxazole or thiazole ring.

15. An image forming method of claim 13 wherein the compound of formula 1 is one of compounds Y-1 through Y-23 defined below:

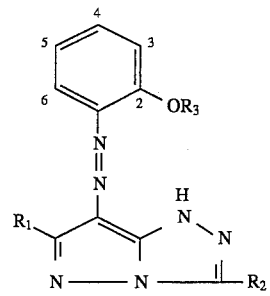

| Compound No. | $R^1$ | $R^2$ | $R^3$ | $R^4$ |
|---|---|---|---|---|
| Y-1 | $-CH_3$ | $-C_4H_9$ | $-CH_3$ | — |
| Y-2 | $-C_3H_7$ (i) | 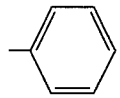 | $-CH_3$ | — |
| Y-3 | $-C_3H_7$ (i) | $-C_2H_5$ | $-CH_3$ | — |
| Y-4 | $-CH_3$ | $-C_2H_5$ | $-CH_3$ | — |
| Y-5 | $-C_3H_7$ (i) | 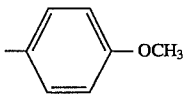 | $-CH_3$ | 4-Cl |
| Y-6 | $-C_3H_7$ (i) | $-C_2H_5$ | $-CH_3$ | $4\text{-}CO_2CH_3$ |
| Y-7 | $-C_3H_7$ (i) | $-C_4H_9$ | $-CH_3$ | $5\text{-}CO_2CH_3$ |
| Y-8 | $-C_4H_9$ (t) | $-C_4H_9$ | $-CH_3$ | — |
| Y-9 | $-C_3H_7$ (i) | 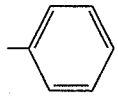 | $-C_3H_7$ (i) | — |
| Y-10 | $-C_3H_7$ (i) | 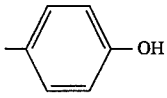 | $-CH_3$ | — |
| Y-11 | $-C_3H_7$ (i) | $-C_3H_7$ | $-CH_3$ | 5-Cl |
| Y-12 | $-C_3H_7$ (i) | 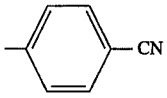 | $-CH_3$ | — |
| Y-13 | $-C_4H_9$ (t) | 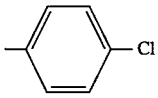 | $-CH_3$ | — |
| Y-14 | $-SCH_3$ | 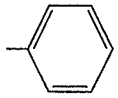 | $-CH_3$ | — |

-continued
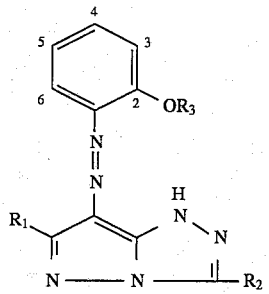
| Compound No. | $R^1$ | $R^2$ | $R^3$ | $R^4$ |
|---|---|---|---|---|
| Y-15 | 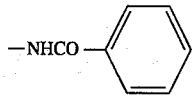 | $-C_2H_5$ | $-CH_3$ | — |
| Y-16 | 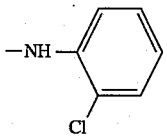 | $-C_2H_5$ | $-CH_3$ | — |
| Y-17 | $-OCH_3$ | $-C_4H_9$ | $-CH_3$ | — |
| Y-18 | $-C_4H_9$ (t) | $-C_4H_9$ | $-CH_3$ | 4-$CO_2H$ |
| Y-19 | $-C_3H_7$ (i) | 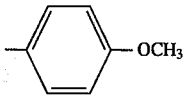 | $-CH_3$ | — |
| Y-20 | $-C_3H_7$ (i) | 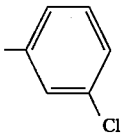 | $-CH_3$ | — |
| Y-24 | $-C_3H_7$ (i) | $-C_2H_5$ | $-CH_3$ | 5-Cl |
| Y-25 | $-C_4H_9$ (t) | $-C_4H_9$ | $-CH_3$ | 5-Cl |
| Y-26 | $-C_4H_9$ (t) | $-C_2H_5$ | $-CH_3$ | 5-Cl |
| Y-27 | $-C_4H_9$ (t) | 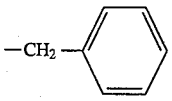 | $-CH_3$ | 5-Cl |
| Y-28 | $-C_4H_9$ (t) | 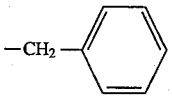 | $-CH_3$ | — |
| Y-29 | $-C_4H_9$ (t) | $-CH(C_2H_5)C_4H_9$ | $-CH_3$ | 5-Cl |
| Y-30 | $-C_4H_9$ (t) | $-C_6H_{13}$ | $-CH_3$ | 5-Cl |
| Y-31 | $-C_4H_9$ (t) | $-CH_3$ | $-CH_3$ | 5-Cl |
Y-21
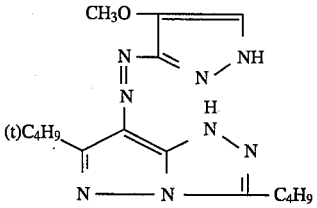

-continued
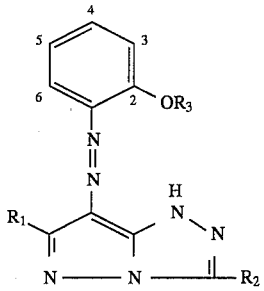
| Compound No. | $R^1$ | $R^2$ | $R^3$ | $R^4$ |
|---|---|---|---|---|
| Y-22 | | 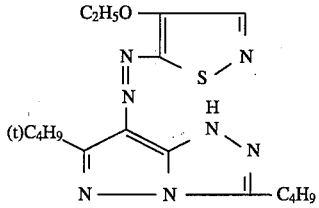 | | |
| Y-23 | | 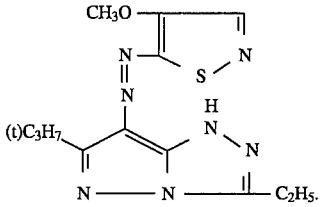 | | |
* * * * *